US008191615B2

(12) United States Patent
So et al.

(10) Patent No.: US 8,191,615 B2
(45) **Date of Patent: *Jun. 5, 2012**

(54) LINKED HEAT EXCHANGERS HAVING THREE FLUIDS

(75) Inventors: Allan K. So, Mississauga (CA); Mark S. Kozdras, Oakville (CA)

(73) Assignee: Dana Canada Corporation, Oakville, Ontario (CA)

( * ) Notice: Subject to any disclaimer, the term of this patent is extended or adjusted under 35 U.S.C. 154(b) by 800 days.

This patent is subject to a terminal disclaimer.

(21) Appl. No.: 11/563,080

(22) Filed: Nov. 24, 2006

(65) Prior Publication Data

US 2008/0121381 A1 May 29, 2008

(51) Int. Cl.

| | |
|---|---|
| ***F28D 7/10*** | (2006.01) |
| ***F28F 9/26*** | (2006.01) |
| ***F28F 9/22*** | (2006.01) |
| ***F28F 3/08*** | (2006.01) |

(52) U.S. Cl. ..... 165/140; 165/144; 165/145; 165/167

(58) Field of Classification Search ..... 165/140, 165/144, 145

See application file for complete search history.

(56) References Cited

U.S. PATENT DOCUMENTS

| | | | | |
|---|---|---|---|---|
| 3,207,216 | A | 9/1965 | Donaldson | |
| 3,537,513 | A | 11/1970 | Austin | |
| 3,752,222 | A | 8/1973 | Olbermann, Jr. | |
| 4,002,201 | A | 1/1977 | Donaldson | |
| 4,081,025 | A | 3/1978 | Donaldson | |
| 4,249,597 | A | 2/1981 | Carey | |
| 4,327,802 | A * | 5/1982 | Beldam | 165/153 |
| 4,462,463 | A | 7/1984 | Gorham, Jr. | |
| 4,479,533 | A | 10/1984 | Persson et al. | |
| 5,408,843 | A | 4/1995 | Lukas et al. | |
| 5,462,113 | A | 10/1995 | Wand | |
| 5,492,171 | A * | 2/1996 | Kallrot | 165/167 |
| 5,538,077 | A | 7/1996 | So et al. | |
| 5,720,341 | A | 2/1998 | Watanabe et al. | |
| 5,884,696 | A | 3/1999 | Loup | |
| 5,893,411 | A | 4/1999 | Nir | |
| 5,964,280 | A | 10/1999 | Wehrmann et al. | |
| 6,142,221 | A | 11/2000 | Johansson | |
| 6,164,371 | A | 12/2000 | Bertilsson | |
| 6,305,466 | B1 | 10/2001 | Andersson et al. | |
| 6,321,832 | B1 | 11/2001 | Le | |
| 6,923,251 | B2 * | 8/2005 | Higashiyama | 165/153 |
| 7,036,572 | B2 * | 5/2006 | Sohn | 165/175 |
| 7,527,091 | B2 * | 5/2009 | Ito et al. | 165/202 |

(Continued)

FOREIGN PATENT DOCUMENTS

| | | |
|---|---|---|
| JP | 61059188 | 3/1986 |

*Primary Examiner* — Cheryl J Tyler
*Assistant Examiner* — Brandon M Rosati
(74) *Attorney, Agent, or Firm* — Ridout & Maybee LLP

(57) ABSTRACT

A heat exchanger apparatus is provided wherein a multifluid or at least three-fluid heat exchanger is mounted externally to but in combination with a two-fluid heat exchanger. The multifluid heat exchanger includes three fluid passages or conduits wherein heat energy can be transferred efficiently between at least one of the fluid conduits and each of the other fluid conduits. The multifluid heat exchanger and two fluid heat exchanger are arranged so that the two heat exchangers share a common fluid, the multifluid heat exchanger, therefore, allowing heat transfer to or from the common fluid to the two other fluids in the multifluid heat exchanger thereby improving the overall heat transfer amongst the fluids.

16 Claims, 15 Drawing Sheets

U.S. PATENT DOCUMENTS

| | | | | |
|---|---|---|---|---|
| 7,703,505 | B2 * | 4/2010 | So et al. | 165/140 |
| 7,946,339 | B2 * | 5/2011 | So et al. | 165/140 |
| 2005/0098308 | A1 * | 5/2005 | Sohn | 165/153 |
| 2005/0150646 | A1 * | 7/2005 | Calhoun et al. | 165/167 |
| 2006/0266501 | A1 | 11/2006 | So et al. | |
| 2011/0180241 | A1 * | 7/2011 | So et al. | 165/148 |

* cited by examiner

LINKED HEAT EXCHANGERS HAVING THREE FLUIDS

FIELD OF THE INVENTION

The invention relates to a multifluid heat exchanger in combination with at least one two fluid heat exchanger for use in automotive cooling systems.

BACKGROUND OF THE INVENTION

In motor vehicles, typically, there are several cooling subsystems such as engine cooling with an engine coolant circuit with a radiator, a transmission oil cooling circuit, an engine oil cooling circuit, a power steering cooling circuit, as well as others associated with axle oil, hydraulic fluid, air conditioning, etc.

It is known that interconnecting the individual cooling circuits can be beneficial to the overall power train and cabin climate control systems, as demonstrated by the incorporation of in-tank transmission coolers in one of the end tanks, most often the cold tank, of the engine cooling radiator. In this type of system, as the water (or engine coolant) flows through the radiator, it is cooled by the cross air flow. At the same time, transmission oil is fed through the in-tank oil cooler which, in turn, is cooled by the cooled by the water (or engine coolant) from the radiator. This type of system provides improved start-up conditions for the vehicle since the water (or engine coolant) from the radiator helps to warm up the transmission oil. However, the amount of heat transfer achieved by this type of system is limited since the size of the in-tank oil cooler is restricted due to its "in-tank" location. As well, the amount of heat transfer with this type of system is limited because the maximum temperature difference between the two heat exchange fluids, i.e. the transmission oil and water (or engine coolant), is limited based on the inherent characteristics and operating temperatures of these fluids. A further disadvantage with this type of system is that the use of an in-tank oil cooler tends to decrease the overall thermal efficiency of the radiator as it is difficult to achieve equal flow distribution across the heat exchanger due to the non-optimal header tank shape and obstruction of flow by the in-tank oil cooler.

As the power density of engines increases, there are greater demands on heat dissipation, leading to the proliferation of supplemental cooling provided by liquid-to-air heat exchangers mounted in series with liquid-to-liquid heat exchangers. For instance, it is common to provide supplemental cooling by mounting an oil-to-air transmission oil cooler in series and downstream from the in-tank oil cooler described above. In this type of system, the transmission oil leaves the in-tank oil cooler and is fed into an oil-to-air heat exchanger where it is subject to further heat exchange due to the greater temperature difference between the oil and the air, thereby allowing further cooling. However, the addition of series mounted heat exchangers for supplemental cooling tends to put additional strain on the automobile radiator, thereby further reducing its thermal efficiency and making it difficult to meet the needs for additional cooling and/or heating requirements of the vehicle in general.

SUMMARY OF THE INVENTION

In the present invention, a multifluid or at least three-fluid heat exchanger is mounted externally to but in combination with a two-fluid heat exchanger, wherein the two heat exchangers share a common fluid and the multifluid heat exchanger allows heat transfer to or from the common fluid to or from the two other fluids in the multifluid heat exchanger to improve the overall heat transfer amongst the fluids.

According to one aspect of the invention, there is provided a heat exchanger apparatus comprising a first heat exchanger having a plurality of stacked tubular members defining a first set of flow channels for the flow of a first fluid through the heat exchanger. The tubular members are spaced apart from each other so as to define a second set of flow channels between adjacent tubular members for the flow of a second fluid through the heat exchanger. The apparatus further includes a second heat exchanger including a plurality of stacked heat exchange modules each including a first fluid conduit having a first primary heat transfer surface, a second fluid conduit having a second primary heat transfer surface, the first primary heat transfer surface being thermally coupled to the second primary heat transfer surface, and a third fluid conduit having a third primary heat transfer surface. The third primary heat transfer surface is thermally coupled to at least the second primary heat transfer surface so that heat can be transferred between at least the second fluid conduits and each of the first and third fluid conduits. The second heat exchanger is mounted external to but in combination with the first heat exchanger so that at least one of the first and second sets of flow channels communicates with one of the first and second fluid conduits in the second heat exchanger, the first and second heat exchangers thereby sharing a common fluid.

According to a second aspect of the invention, there is provided a method of exchanging heat amongst a plurality of fluids comprising the steps of providing a first heat exchanger, bringing a first fluid into juxtaposition with a second fluid in the first heat exchanger to exchange heat therebetween when the two fluids are at different temperatures, providing a second heat exchanger, and bringing one of the first and second fluids into juxtaposition with a third fluid or a fourth fluid in the second heat exchanger to exchange heat between the one of the first and second fluids and the third fluid or fourth fluid when there is a temperature differential between the one of the first and second fluids and the third or fourth fluid.

According to a third aspect of the invention, there is provided a method of exchanging heat amongst a plurality of fluids comprising the steps of providing a first heat exchanger and bringing a first fluid into juxtaposition with a second fluid in the first heat exchanger to exchange heat therebetween when the two fluids are at different temperatures, providing a second heat exchanger having a first subsection and a second subsection, and bringing the first and second fluids into juxtaposition with a third fluid in the first subsection of the second heat exchanger to exchange heat between the first and second fluids and the third fluid when there is a temperature differential between said fluids, and bringing the first fluid into juxtaposition with a fourth and fifth fluid in the second subsection of the second heat exchanger to exchange heat between the first fluid and the fourth and fifth fluids when there is a temperature differential between the fluids.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENTS

Figure 1:
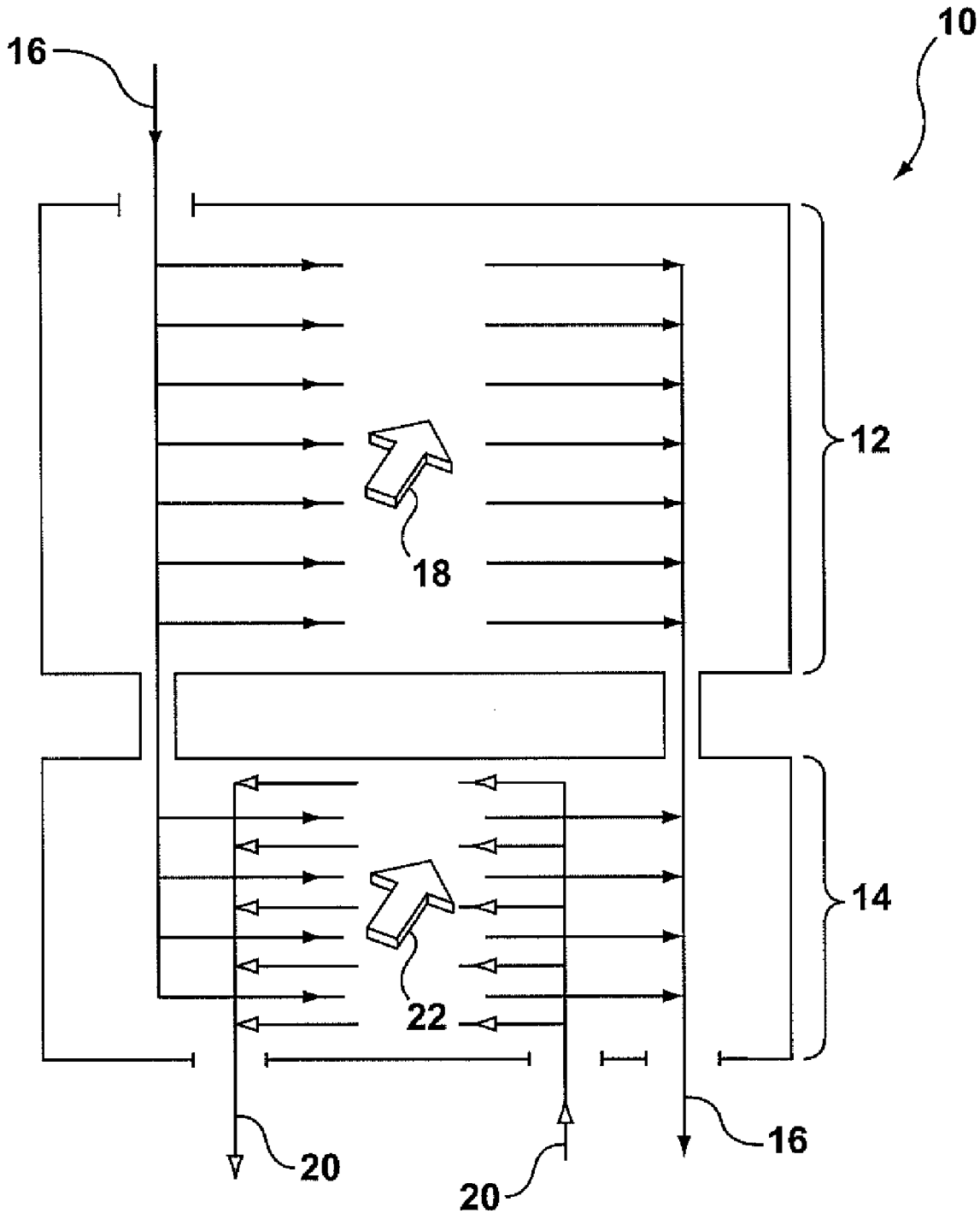
FIG. 1 is a schematic flow diagram of a heat exchanger apparatus according to one embodiment of the invention.

Referring first to FIG. 1, there is shown a schematic flow diagram of a heat exchanger apparatus 10 according to a preferred embodiment of the invention. Heat exchanger apparatus 10 is formed of a first two fluid heat exchanger 12, and a second multifluid heat exchanger 14. In the present embodiment, the first heat exchanger 12 represents an oil-to-air heat exchanger and is in the form of a plate and fin type heat exchanger formed of a plurality of stacked tubular members (not shown) having a first set of flow channels (not shown) for the flow of a first fluid 16 through the heat exchanger 12. The plurality of stacked tubular members are spaced apart from each other so as to form a second set of flow channels (not shown) for the flow of a second fluid 18 through the heat exchanger 12. In the case of an automobile radiator, the second fluid 18 is air flowing through the heat exchanger 12 in a direction transverse to the flow of the first fluid 16.

The second or multifluid heat exchanger 14 can accommodate the flow of at least three separate heat exchange fluids therethrough, and is mounted externally to but in communication with the first heat exchanger 12. The heat exchangers 12, 14 are coupled together in a relatively compact arrangement so that the heat exchanger apparatus 10 can be mounted in an automobile with minimal installation requirements. The heat exchangers 12, 14 are coupled together so that at least one fluid flowing through the first heat exchanger 12 also flows through the second heat exchanger 14. As shown in the schematic flow diagram of FIG. 1, the first and second heat exchangers 12, 14 share first fluid 16 as a common fluid. The heat exchangers 12, 14 can be brazed together which reduces the number of connectors or fittings required in the system which helps to reduce the potential for leaks.

In use in an automobile application, the heat exchanger apparatus 10 is mounted externally to the primary radiator of the vehicle. The first heat exchanger 12 is coupled to the transmission of the vehicle and provides oil-to-air cooling for the transmission oil (or fluid). The second multifluid heat exchanger 14 shown in FIG. 1 would be mounted together with the first heat exchanger 12 so as to share the transmission oil as the first fluid 16 between the two heat exchangers. The second multifluid heat exchanger would also be fed with water or engine coolant derived from the automobile radiator as the second fluid 20. The third fluid, represented by flow arrow 22, flowing through the second heat exchanger 14 would be air, which may or may not be derived from the same source as for the first heat exchanger 12.

The second or multifluid heat exchanger 14 is structured so as to allow at least one of the three fluids flowing therethrough to benefit from heat exchange with the two other fluids flowing through the multifluid heat exchanger 14. In the automobile application discussed above, the heat exchanger apparatus 10 would be coupled to the transmission and to the radiator in such a way so that at least the shared or common fluid 16, i.e. the transmission oil in the second multifluid heat exchanger 14 would be subject to heat exchange with both the water or engine coolant, i.e. the second fluid 20, as well as the air or third fluid 22. Therefore, the transmission oil would benefit from both liquid-to-liquid and liquid-to-air heat transfer without the use of an in-tank oil cooler. By removing the in-tank oil cooler, the overall thermal efficiency of the automobile radiator is increased. Therefore, water or engine coolant leaving the radiator is cooler and tends to be flowing at a higher rate than the water or engine coolant leaving a radiator having an in-tank oil cooler. Accordingly, the water or engine coolant that is fed into the second multifluid heat exchanger 14 of heat exchanger apparatus 10 offers a greater degree of heat transfer with the transmission oil than in the case of an in-tank oil cooler. For the purpose of example, the engine coolant or water running through a radiator of an automobile during normal operation of the vehicle would be at a temperature of approximately 90° C. and would be subject to heat exchange with the ambient air flowing through the radiator. Transmission fluid or oil, during normal operation of the vehicle is at a temperature of approximately 125° C. In addition to the heat exchange between the transmission oil and the water or engine coolant in the second multifluid heat exchanger, the transmission oil also benefits from heat transfer with the air that flows though the heat exchanger apparatus 10.

Heat exchanger apparatus 10 also provides improved engine start-up. More specifically, for engine start-up conditions on a cold day where the oil or transmission fluid (i.e. the common fluid or first fluid 16 in the multifluid heat exchanger 14) is relatively cold and viscous, the air passing through the heat exchanger apparatus 10 would not be able to warm up the oil very quickly because of the extremely cold ambient conditions. However, as the engine starts to warm up, the coolant or second fluid 20 flowing through multifluid heat exchanger 14 is able to warm up the oil very quickly. Accordingly, improved engine start-up conditions are achieved without the use of an in-tank oil cooler.

Figure 17:
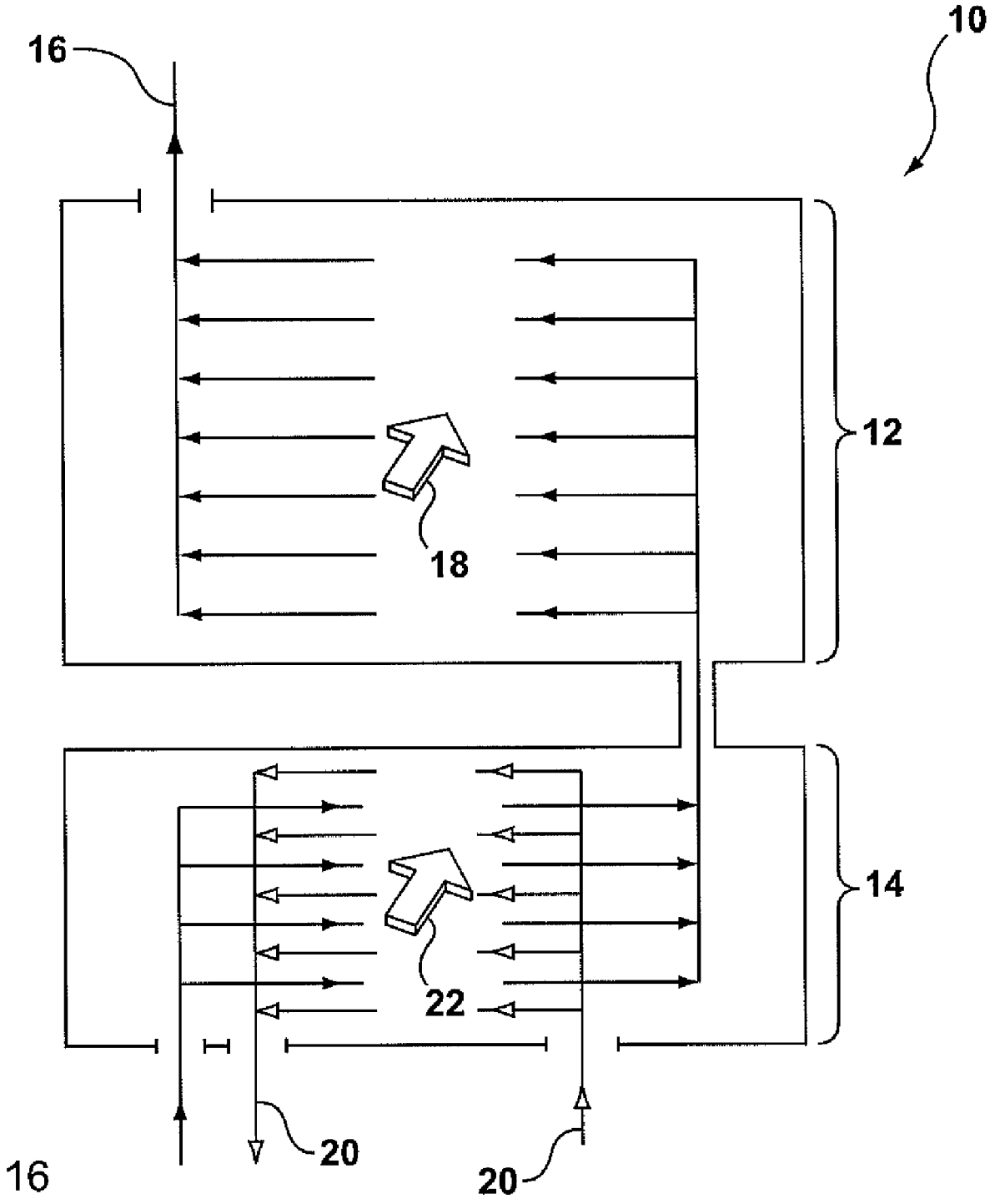
FIG. 17 is a schematic flow diagram of a variant of the heat exchanger apparatus shown in FIG. 1.

FIG. 17 is a schematic flow diagram showing an alternate set-up of the heat exchanger apparatus 10 of FIG. 1. In this embodiment, the heat exchanger apparatus 10 would be coupled to the transmission and downstream to the radiator in such a way that the transmission oil or first fluid 16 and water or second fluid 20 would first be fed into the second multifluid heat exchanger 14 counter-flow to each other. The transmission oil or first fluid 16 would then be shared with the first heat exchanger 12, which again would be an oil-to-air heat exchanger, for subsequent oil-to-air cooling.

Figure 2:
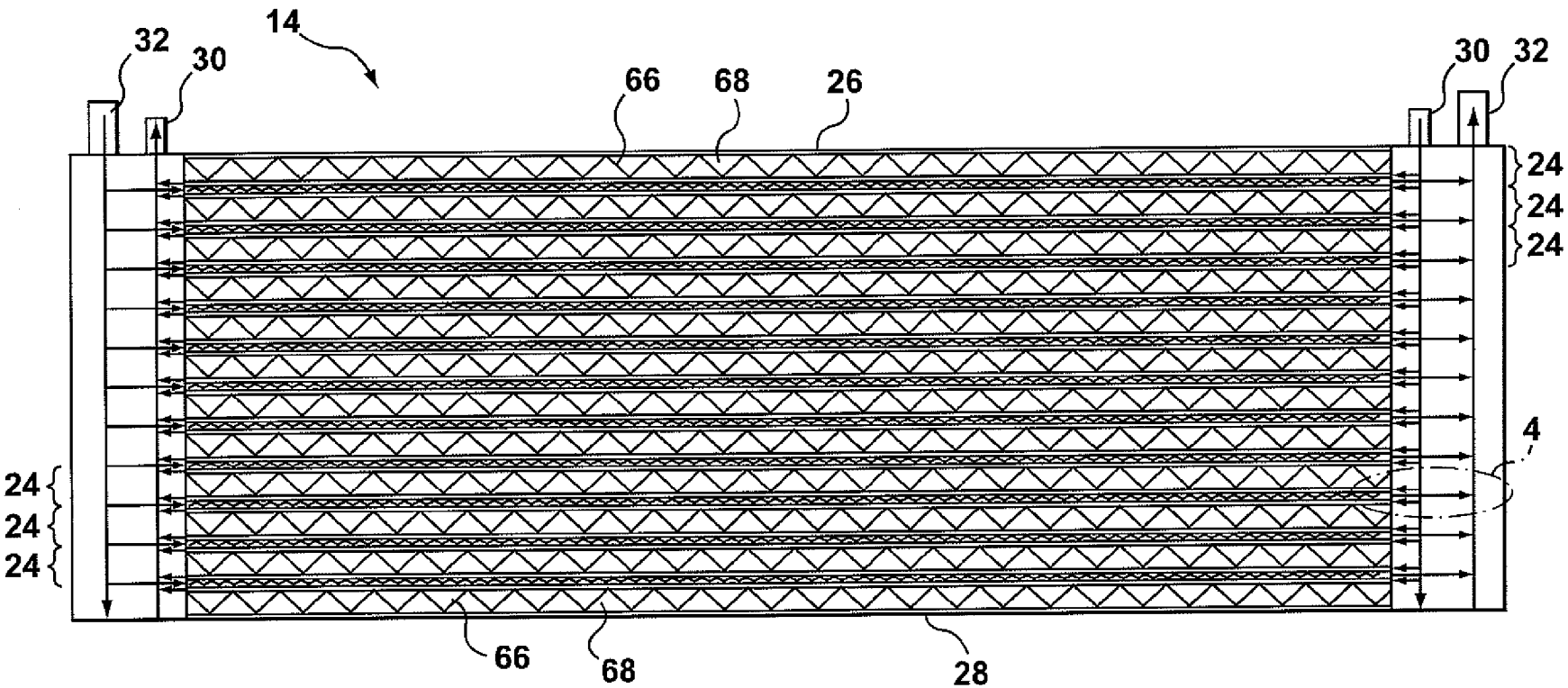
FIG. 2 is a diagrammatic elevational view of a preferred embodiment of a multifluid heat exchanger which forms part of the heat exchanger apparatus of the present invention.
Figure 3:
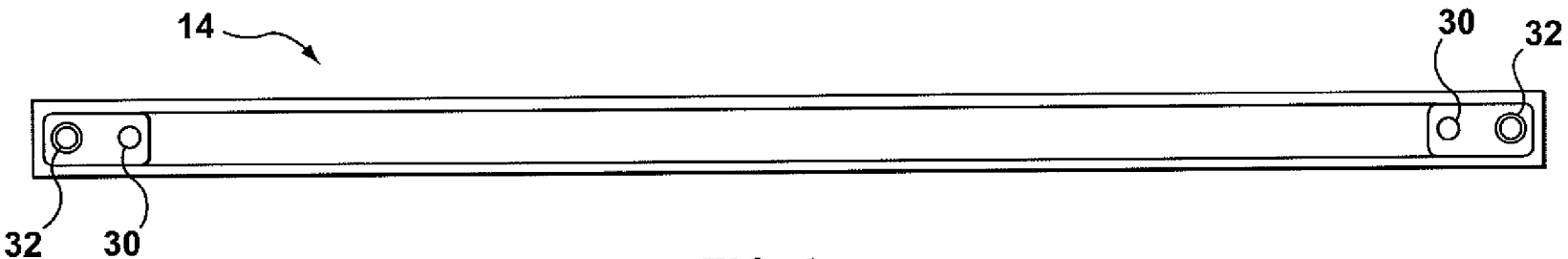
FIG. 3 is a top plan view of the multifluid heat exchanger shown in FIG. 2.

Referring now to FIGS. 2-8, there is shown a preferred embodiment of the second or multifluid heat exchanger 14. As shown, multifluid heat exchanger 14 is formed of a plurality of stacked heat exchange modules 24, the right hand end of one of which is shown best in FIG. 5. Multifluid heat exchanger 14 has a top plate 26 and a bottom plate 28, a pair of inner nipples 30 and a pair of outer nipples 32. The inner and outer nipples 30, 32 form the inlets and outlets for two of the heat exchange fluids used in the multifluid heat exchanger 14, as will be described further below. While both the inner and outer nipples 30, 32 are shown in FIG. 2 as being formed in the top plate 26, it will be understood by those skilled in the art that one or both of the inner or outer nipples 30, 32 could instead be located in the bottom plate 28 depending on the particular application of the heat exchanger apparatus 10.

Each heat exchange module 24 is formed by a pair of spaced-apart plates 34, 36 and a pair of back-to-back intermediate plates 38, 40. The spaced-apart plates 34, 36 are identical, one of them just being turned upside down. Similarly, intermediate plates 38, 40 are identical, one of them again just being turned upside down. Intermediate plates 38, 40 are formed with undulations in the form of parallel ribs 42 and grooves 44. A rib 42 on one of the plates 38, 40 becomes a groove 44 when the plate is turned upside down. Ribs and grooves 42, 44 are obliquely orientated, so that they cross when the intermediate plates 38, 40 are put together and thus form an undulating longitudinal flow path or first fluid conduit 46 (see FIG. 8) between the intermediate plates 38 and 40. When the top spaced-apart plate 34 is placed against the intermediate plate 38, the ribs 42 on intermediate plate 38 engage the underside of top plate 34 and provide a tortuous longitudinal flow path or second fluid conduit 48 between plates 34 and 38. A similar tortuous longitudinal flow path or another second fluid conduit 50 is formed between plates 40 and 36.

Although two intermediates plates 38, 40 are shown in FIGS. 4 to 8, it will be appreciated that only one of the intermediate plates 38, 40 is required. This would still give either the longitudinal fluid conduits 46, 48 (if only intermediate plate 38 is used), or fluid conduits 46, 50 (if only intermediate plate 40 is used).

Intermediate plates 38, 40 are formed with bosses 52 defining inlet or outlet openings 54. The bosses 52 and inlet/outlet openings 54 are located near each end of the plates to allow fluid to pass through the central longitudinal flow path or first fluid conduit 46 between intermediate plates 38, 40. Intermediate plates 38, 40 also have inlet/outlet openings 56 near the ends of the plates to allow a second fluid to pass through the back-to-back intermediate plates 38, 40 and flow through the longitudinal fluid conduits 48 and 50, respectively, between plates 34, 38 and 36, 40.

Figure 4:
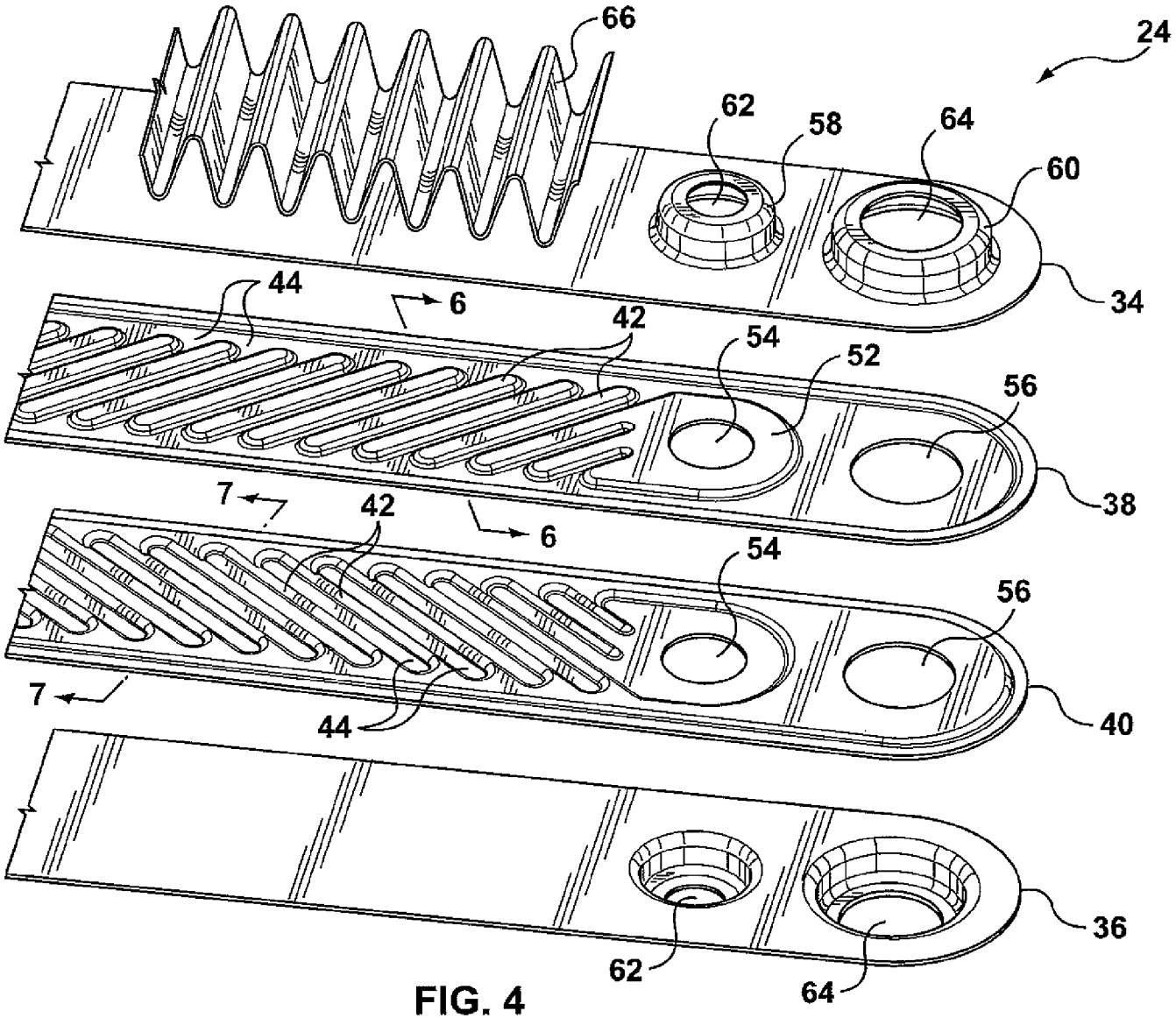
FIG. 4 is an enlarged, exploded perspective view of the encircled area 4 of FIG. 2.
Figure 5:
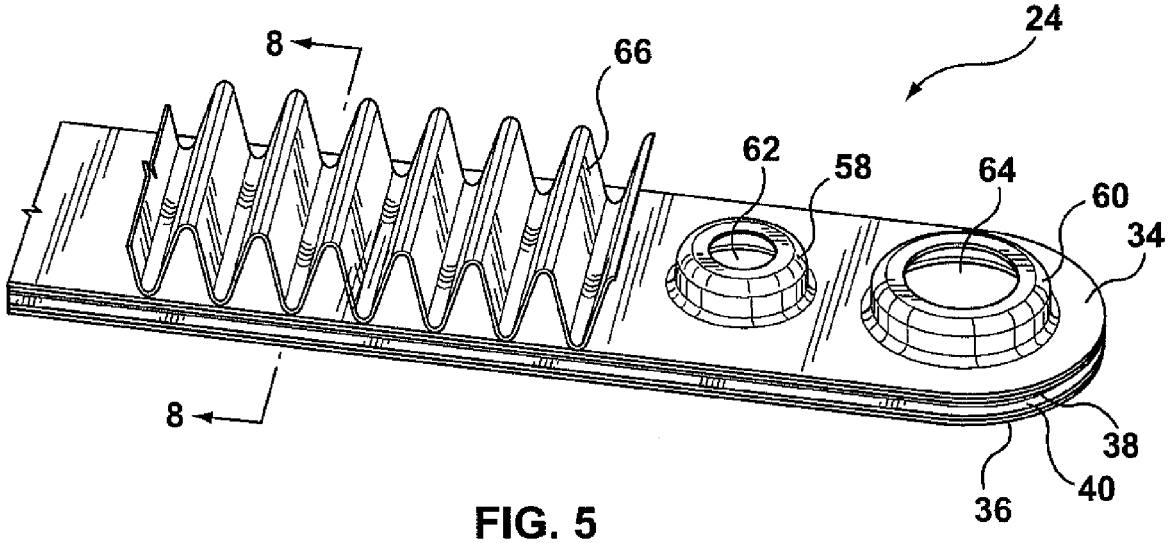
FIG. 5 is a perspective view of the assembled components shown in FIG. 4.
Figure 6:
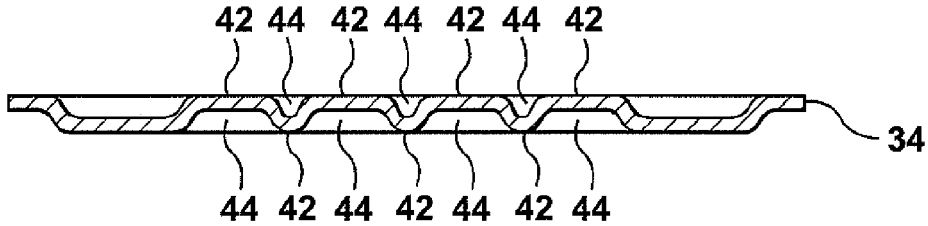
FIG. 6 is a cross-sectional view taken along lines 6-6 of FIG. 4.
Figure 7:
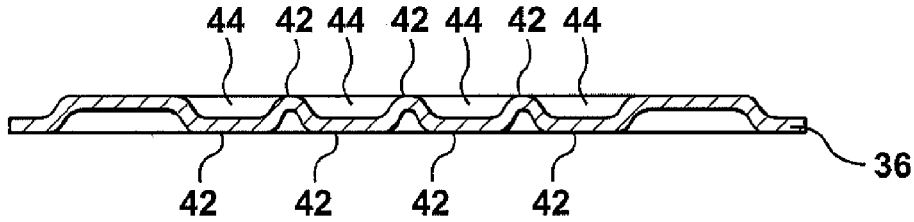
FIG. 7 is a cross-sectional view taken along lines 7-7 of FIG. 4.
Figure 8:
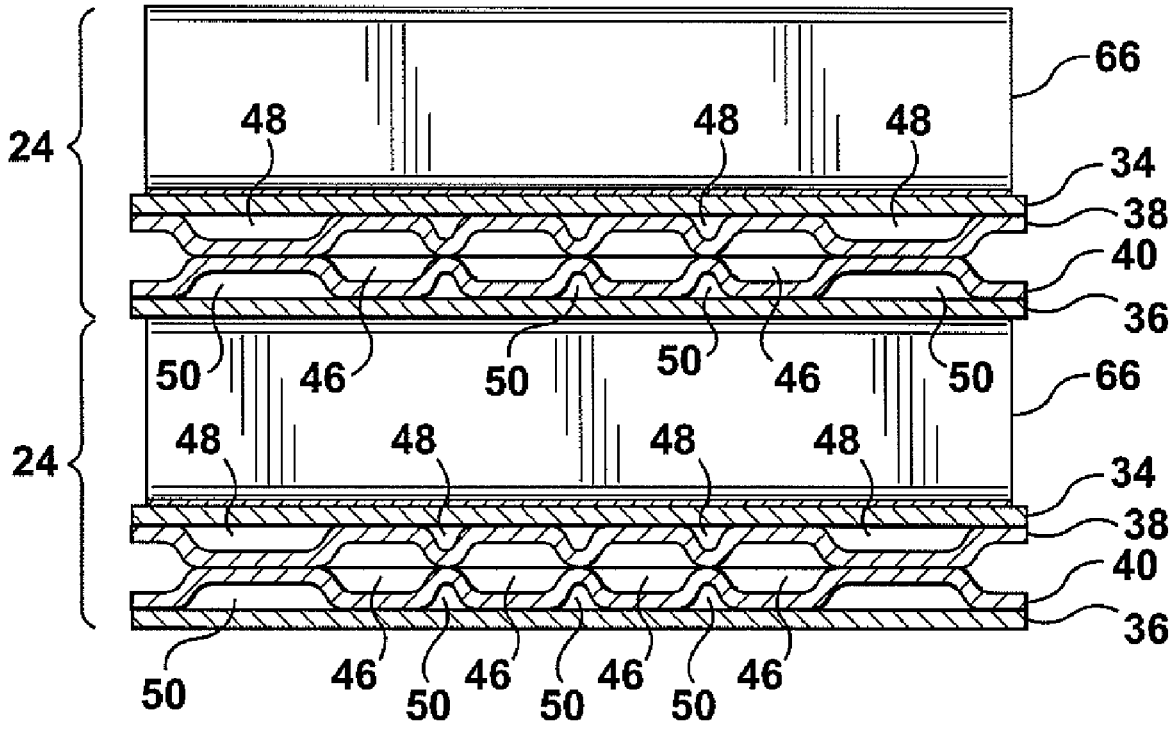
FIG. 8 is a cross-sectional view taken along lines 8-8 of FIG. 5, but showing two stacked heat exchange modules.
Figure 9:
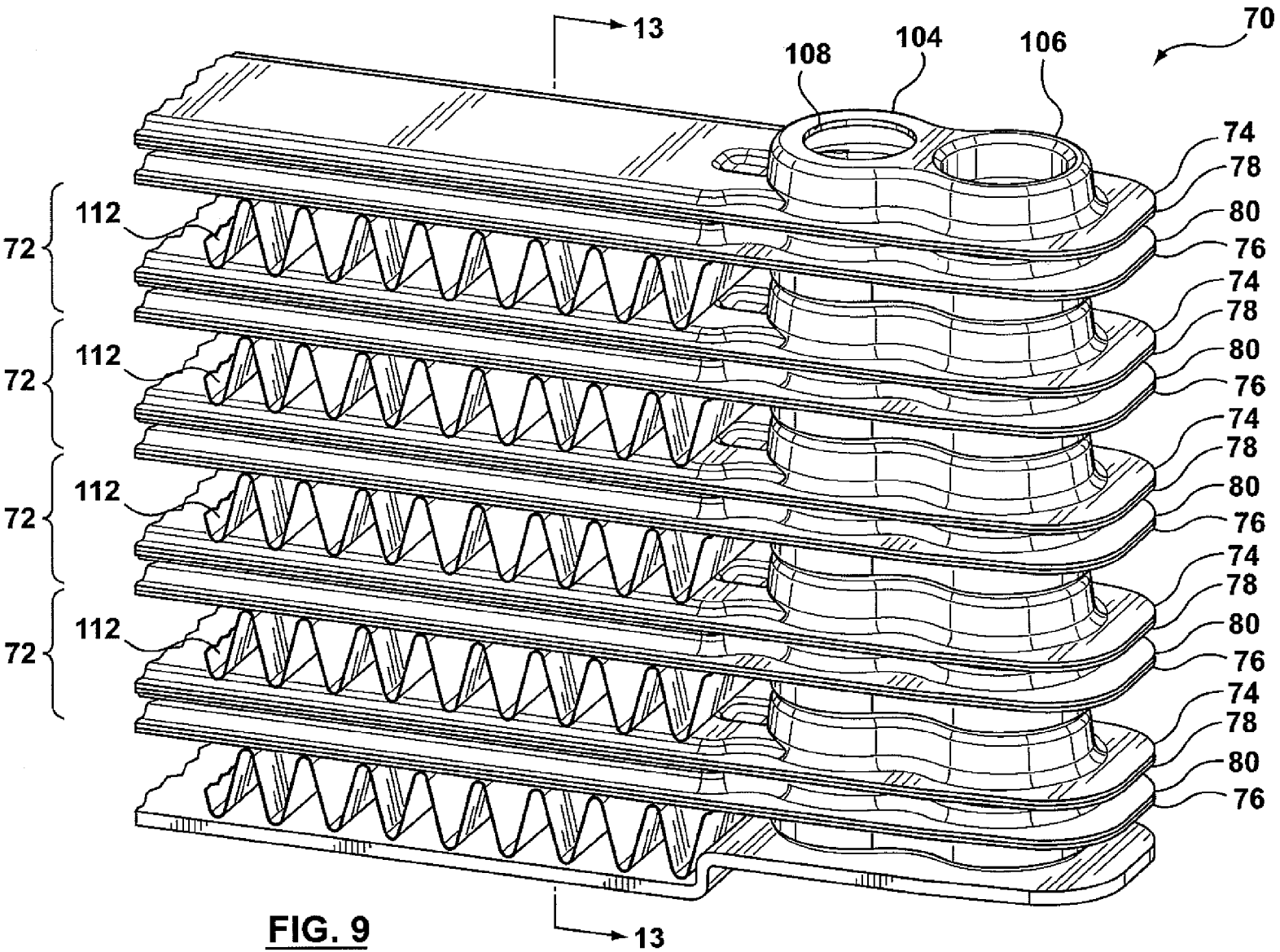
FIG. 9 is a perspective view of a portion of another embodiment of a multifluid heat exchanger which forms part of the heat exchanger apparatus of the present invention.
Figure 10:
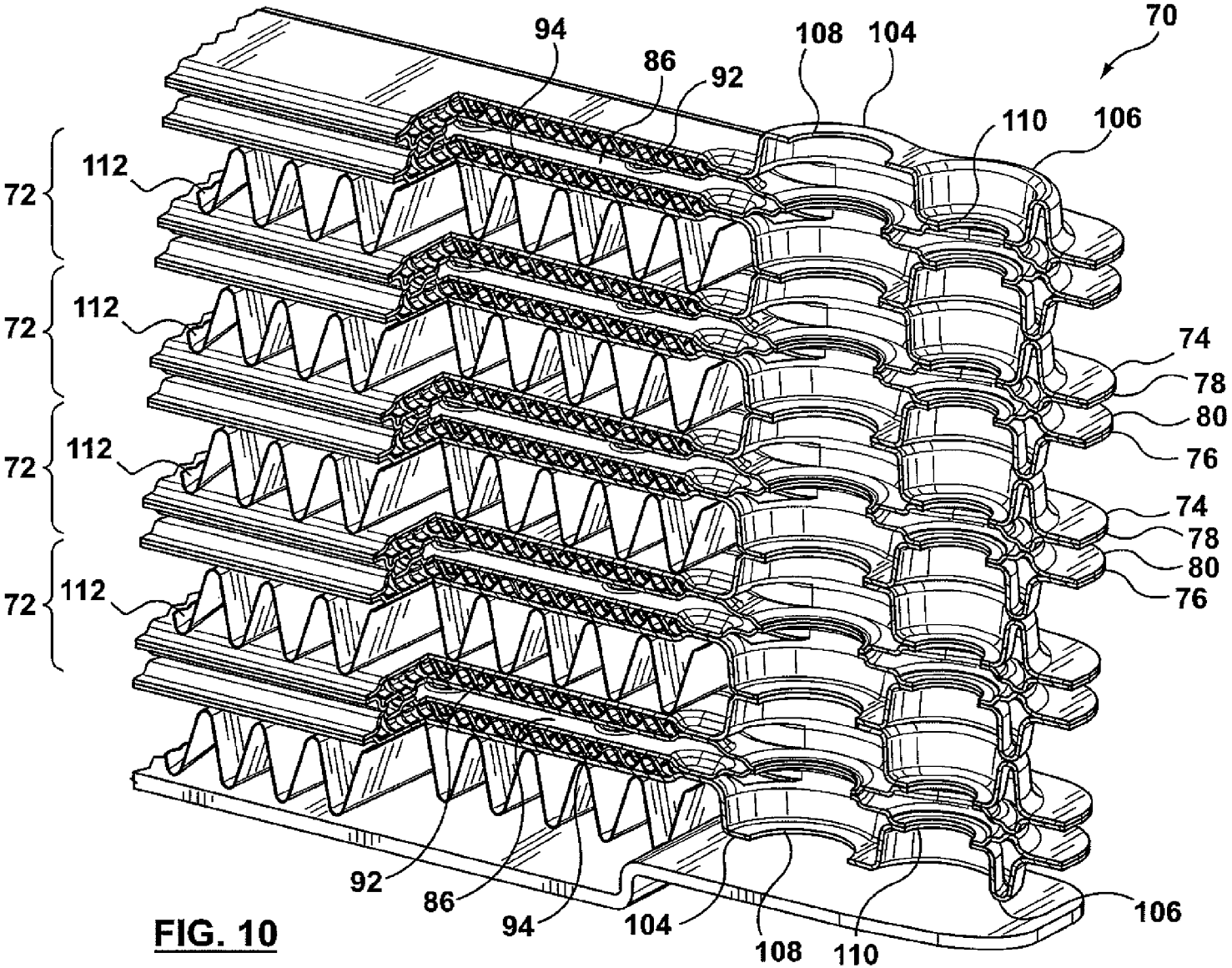
FIG. 10 shows a partial cut-away view of the components shown in FIG. 9.
Figure 11:
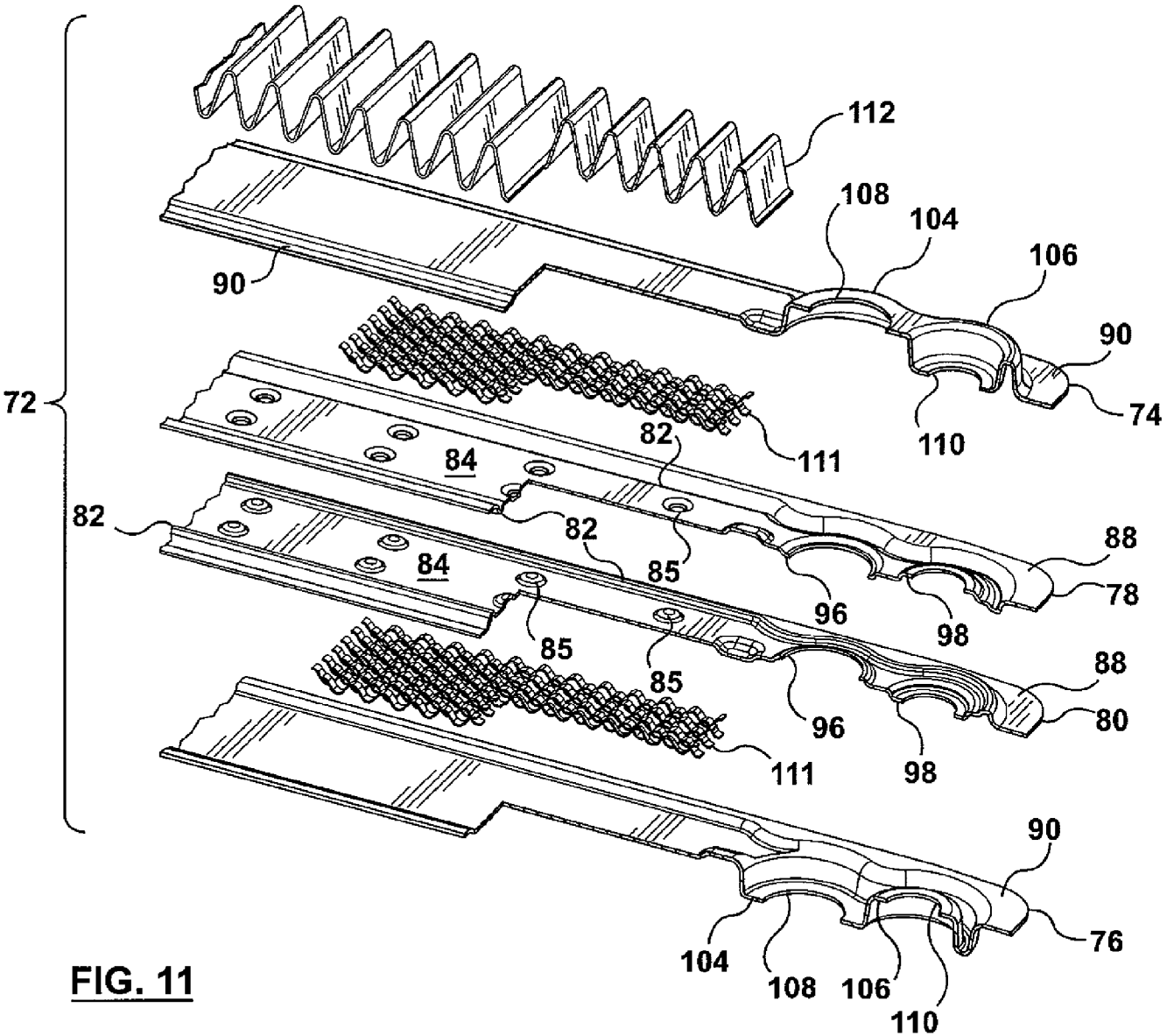
FIG. 11 is an enlarged, exploded perspective view of one of the heat exchange modules which make up the heat exchanger shown in FIGS. 9 and 10.
Figure 12:
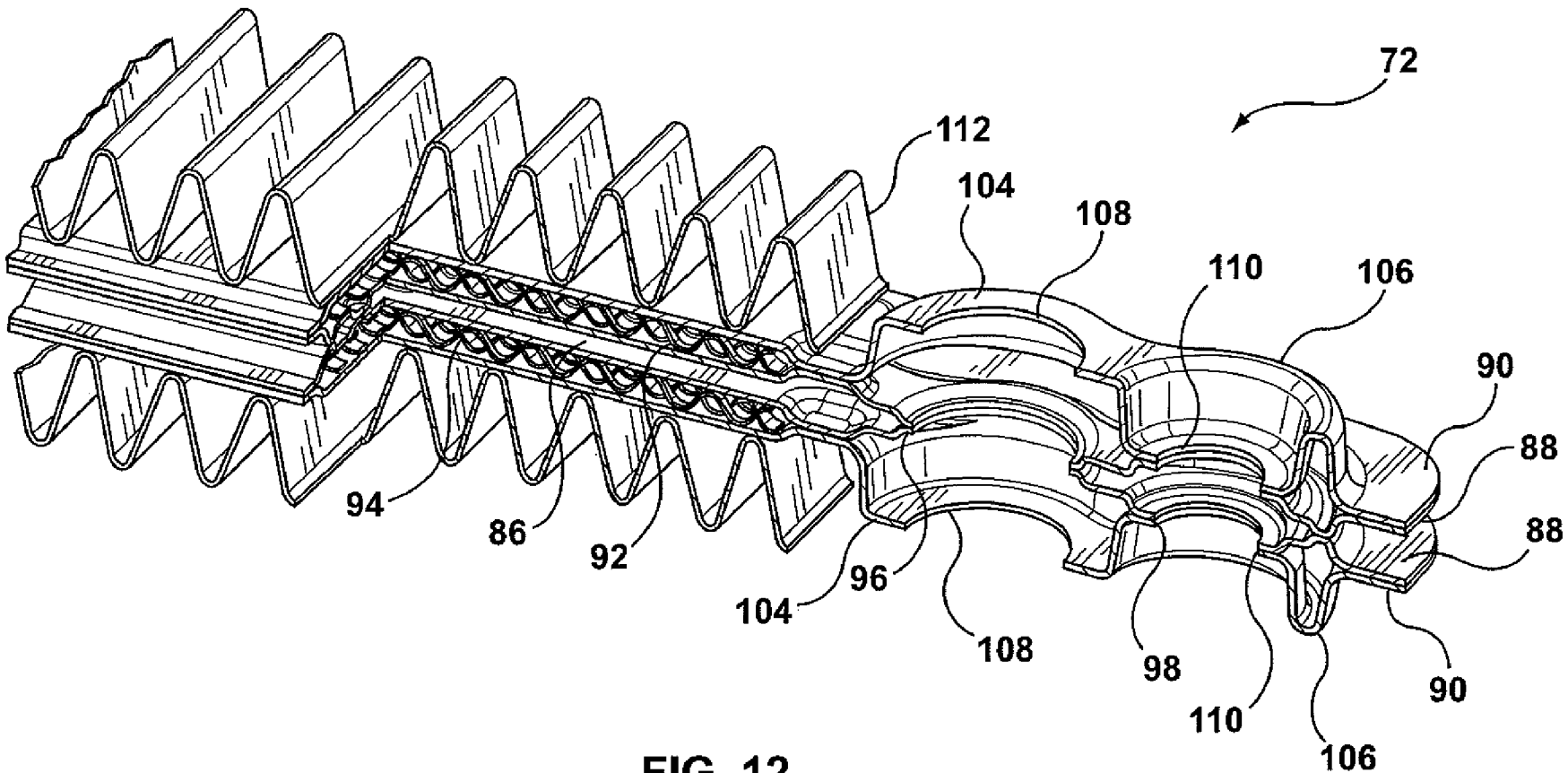
FIG. 12 is a perspective view of the assembled components shown in FIG. 11.
Figure 13:
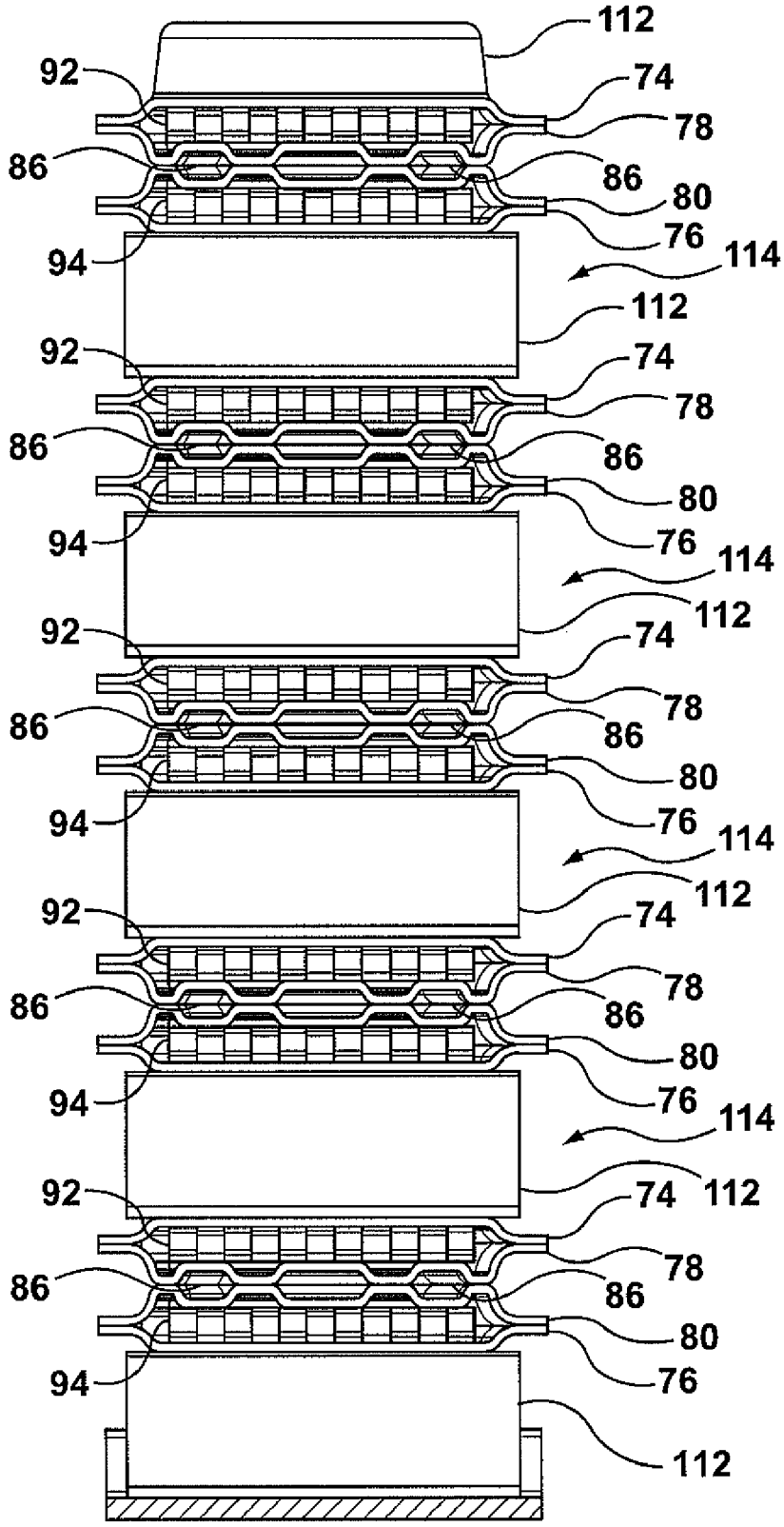
FIG. 13 is a cross-sectional view taken along lines 13-13 in FIG. 9.

As seen best in FIG. 4, spaced-apart plates 34, 36 are also formed with bosses 58 and 60 defining respectively inlet/outlet openings 62, 64. Inlet/outlet openings 62 communicate with the flow path of first fluid conduit 46, and the inlet/outlet openings 64 communicate with the longitudinal flow paths or second fluid conduits 48 and 50. It will be appreciated that the openings 62, 64 at each end of the modules 24 could be either inlet openings or outlet openings depending upon the direction of flow desired through module 24.

Each module 24 also has a heat transfer fin 66 attached thereto. The plates and fins of heat exchanger 14 are preferably formed of brazing clad aluminum, although the fins 66 could be formed of a plain aluminum alloy, so that all of the plates and fins can be assembled and joined together in a brazing furnace.

Bosses 58, 60 extend in height approximately one-half the height of fins 66, to ensure good contact between the fins 66 and plates 34, 36 during the brazing process. Bosses 58, 60 extend outwardly, so that the bosses in adjacent heat exchange modules 24 engage to form flow manifolds.

In use, each of the first and second fluid conduits 46, 48, 50 has a primary heat transfer surface in the form of the common wall between them. The first primary heat transfer surface is thermally coupled to the second primary heat transfer surface allowing heat transfer between the respective fluids passing through inlet/outlet openings 62, 64. The spaced-apart plates 34, 36 in adjacent heat exchange modules 24 define third fluid conduits 68 in which the fins 66 are located. It will be appreciated that a third fluid conduit 68 is located on one side of the first and second conduits 46, 48, and the third fluid conduit 68 of an adjacent heat exchange module 24 is located on the opposite side of the first and second conduits 46, 48 (i.e. adjacent first and second conduits 46, 50). It will be understood that in connection with this type of multifluid heat exchanger 14, the first and second fluid conduits 46, 48/50 are considered to be tubular members disposed in juxtaposition. The third fluid conduits 68, are in the form of air passages containing fins 66, and are located laterally adjacent to the first and second fluid conduits 46 and 48/50. Third fluid conduits 68 also have primary heat transfer surfaces which are the wall portions of plates 34 and 36 located between the air passages 68 and the fluid conduits 46, 48/50. The third primary heat transfer surfaces are thermally coupled to both of the first and second primary heat transfer surfaces formed by intermediate plates 38, 40 so that heat can be transferred between any one of the fluid conduits and each of the other fluid conduits thermally coupled thereto by the primary heat transfer surfaces therebetween. For the purposes to this disclosure, the term thermally coupled means being capable of transferring heat energy through at least one wall separating the adjacent conduits.

In the automotive application discussed above in connection with FIG. 1, if the fluid conduit 46 located centrally between intermediate plates 38, 40 is considered to be the first fluid conduit, it would have a first primary heat transfer surface in the form of the undulating walls or ribs and grooves 42, 44 forming this conduit. This first fluid conduit 46 could be used for the flow of engine coolant or water through heat exchanger 14. The second fluid conduit could be the flow passages or conduits 48, 50 and it could be considered to have a second primary heat transfer surface, which again is the undulations that form the ribs and grooves 42, 44 in intermediate plates 38, 40. Transmission oil could pass through the second fluid conduit 48, 50, which could be cooled by the engine coolant or water in the first fluid conduit 46. The third fluid conduit 68, which of course would be the air passage above plate 34, would allow air as the heat transfer fluid to cool both the engine coolant or water in the first fluid conduit 46 and the engine or transmission oil in the second fluid conduit 48, 50. This would be the normal operation of heat exchanger 14. However, as discussed above, in engine start-up conditions on a cold day where the engine or transmission oil in the second fluid conduit 48, 50 is relatively cold and viscous, the air passing through air passages 68 might not be able to warm up the oil due to the extremely cold ambient conditions. Instead, as the engine starts to warm up, the coolant flowing through the first fluid conduit 46 would help to warm up the oil very quickly. It will be appreciated that because, in this embodiment, heat transfer can occur between each of the three fluid conduits, the choice of fluids flowing through the first and second fluid conduits 46 and 48, 50 could be reversed and the same results could be achieved. As well, since heat exchange can occur between each of the three fluid conduits, a multifluid heat exchanger 14 of this type also allows for additional heat exchange between the engine coolant or water and the air flowing through the second or multifluid heat exchanger 14 in certain conditions.

The multifluid heat exchanger discussed above is disclosed in co-pending, commonly owned U.S. patent application Ser. No. 11/381,863 filed May 5, 2006, the disclosure of which is hereby incorporated by reference in its entirety.

Referring now to FIGS. 9-13, there is shown another embodiment of a second or multifluid heat exchanger 70 which maybe used in the heat exchanger apparatus 10 of the present invention. Heat exchanger 70 is also formed of a plurality of stacked heat exchange modules 72. Each heat exchange module 72 is formed by a pair of spaced-apart plates 74, 76 and a pair of back-to-back intermediate plates 78, 80. The spaced-apart plates 74, 76 are identical, one of them just being turned upside down. Similarly, intermediate plates 78, 80 are identical, one of them again just being turned upside down. Intermediate plates 78, 80 have peripheral ribs 82 formed around the periphery of the plates which project out of a central generally planar portion 84 of the plates 78, 80. When considering the top intermediate plate 78, the peripheral rib 82 extends below the central planar portion 84, while in the bottom intermediate plate 80, the peripheral rib 82 projects upwardly from the central planar portion 84 of the plate 80. When the intermediate plates 78, 80 are put together, the peripheral ribs 82 meet and form a first flow passage or fluid conduit 86 therebetween. The central generally planar portion 84 may be formed with dimples 85 or other heat transfer enhancing projections.

The intermediate plates 78, 80 also have peripheral flanges 88 which are formed in a plane parallel to and spaced apart from the planar central portion 84. When considering the top intermediate plate 78, the peripheral flange is located in a plane above the planar central portion 84, and when considering the bottom intermediate plate 80, the peripheral flange 88 is in a plane below the central planar portion 84. Spaced-apart plates 74, 76 are also formed with peripheral flanges 90 which correspond to the peripheral flanges 88 on the intermediate plates 78, 80. Therefore, when the spaced-apart plates 74, 76 are stacked together with the intermediate plates 78, 80, the peripheral flanges 88, 90 meet and second flow passages or flow conduits 92, 94 are formed between the plates 74 and 78, and between plates 80 and 76 (see FIGS. 12 and 13).

Intermediate plates 78, 80 are formed with first and second bosses 96, 98 defining inlet or outlet openings 100, 102. The bosses 96, 98 correspond to first and second bosses 104, 106, respectively, formed in the spaced-apart plates 74, 76 which define inlet or outlet openings 108, 110. When considering intermediate plates 78, 80 the first bosses 96 are inwardly disposed with respect to the plates while the second bosses 98 are outwardly disposed with respect to the plates. As for the spaced-apart plates 74, 76, the first bosses 104 are outwardly disposed with respect to the plates while the second bosses 106 are inwardly disposed with respect to the plates. When the spaced-apart plates 74, 76 and intermediate plates 78, 80 are stacked together, the bosses 96, 98 and 104, 106 align so as to allow the flow of fluid into the first fluid conduit 86 and second conduits 92, 94, and the bosses 96, 98 and 104, 106 engage with the corresponding bosses of an adjacent heat exchange module 72 to form first and second inlet and outlet manifolds. As best shown in FIGS. 10-13, the first fluid conduit 86 is a central, longitudinal flow path with a second fluid conduit 92, 94 located on either side thereof. The second fluid conduits 92, 94 may include turbulizers 111 to help increase heat exchange between the fluid flowing therein and the fluid in the adjacent fluid conduits.

Each heat exchanger module 72 also has a heat transfer fin 112 attached one side thereof. Fins 112 may be any conventional type, plain or louvered, as desired. As heat exchanger modules 72 are stacked together, the spaced-apart plates 74, 76 in adjacent heat exchange modules 72 define third fluid conduits 114 in which the fins 112 are located. It will be appreciated that a third fluid conduit 114 is located on one side of the second conduit 92 and that the third fluid conduit 114 of an adjacent heat exchange module 24 is located on the opposite side of the second fluid conduit 94. As with the embodiment of the second heat exchanger 14 discussed above, the first fluid conduit 86 in the subject heat exchanger 70 has a first primary heat transfer surface in the form of the walls forming this conduit. The second fluid conduits 92, 94 have a second primary heat transfer surface in the form of the walls forming the respective conduits, the first primary heat transfer surface being thermally coupled to the second primary heat transfer surface by means of the common wall shared between them first and second fluid conduits. The third fluid conduit 114 has a third primary heat transfer surface corresponding to the common wall between the third and the second fluid conduits 92, 94, the third primary heat transfer surface being thermally coupled to the second primary heat transfer surface. Therefore, fluid flowing in the second fluid conduit 92, 94 is subject to heat exchange with the fluids in both the first fluid conduit 86 and the third fluid conduit 114.

In the automobile application discussed above wherein the second multifluid heat exchanger is coupled to a two fluid heat exchanger in the form of an oil-to-air transmission oil heat exchanger, the oil-to-air heat exchanger would be coupled to the multifluid heat exchanger 70 so that the transmission oil or fluid would flow through the second fluid conduits 92, 94, while the water or engine coolant received from the automobile radiator is fed through the first fluid conduit 86 of the multifluid heat exchanger 70. Therefore, the transmission fluid or oil would be subject to heat exchange with both the engine coolant or water as well as the air thereby achieving the same engine start-up advantages discussed above.

The multi-fluid heat exchanger described above is disclosed in co-pending, commonly owned U.S. Pat. No. 7,703,505, filed Nov. 24, 2006, the disclosure of which is hereby incorporated by reference in its entirety.

Figure 14:
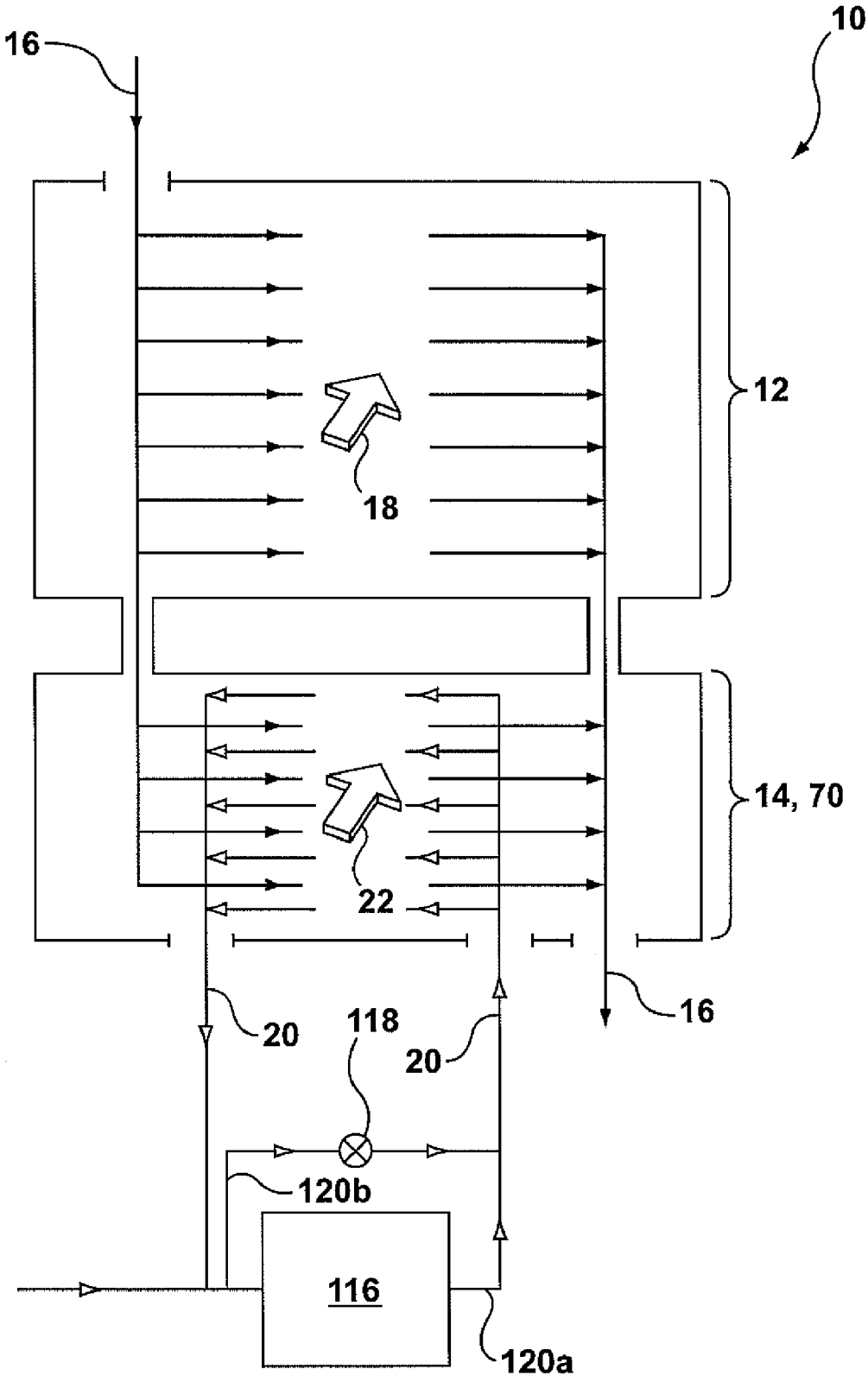
FIG. 14 is a schematic flow diagram of a heat exchanger apparatus according to another embodiment of the invention.

Referring now to FIG. 14, there is shown a schematic flow diagram of the heat exchanger apparatus 10 shown in combination with the automobile radiator 116 with additional valve components to further increase the overall efficiency of the system. As discussed above in connection with FIG. 1, the heat exchanger apparatus 10 is comprised of an oil-to-air heat exchanger as the first heat exchanger 12 which is coupled to one of the embodiments of the second multifluid heat exchanger 14, 70. The first and second heat exchangers 12, 14/70 would share transmission fluid or oil as the common or first fluid 16, and the multifluid heat exchanger 14/70 would also be fed with engine coolant or water from the radiator 116 as its second fluid 20. Depending on which embodiment of the heat exchanger 14/70 was being used would determine whether the common fluid or first fluid 16 was fed into the first or second fluid conduit of the multifluid heat exchanger 14/70 since the oil is the fluid requiring heat transfer with the two other fluids in the heat exchanger apparatus 10. The third fluid 22 flowing through the second multifluid heat exchanger

14/70 would be air, and air would also be flowing through the first heat exchanger 12 as represented by flow arrow 18. In this embodiment, the heat exchanger apparatus 10 is coupled to the radiator 116 using additional thermal valves 118 and/or thermal sensors to control whether cold radiator flow 120*a* or hot radiator flow 120*b* is fed into the multifluid heat exchanger 14/70 so as to adjust to the different operating or cold start-up conditions.

Figure 15:
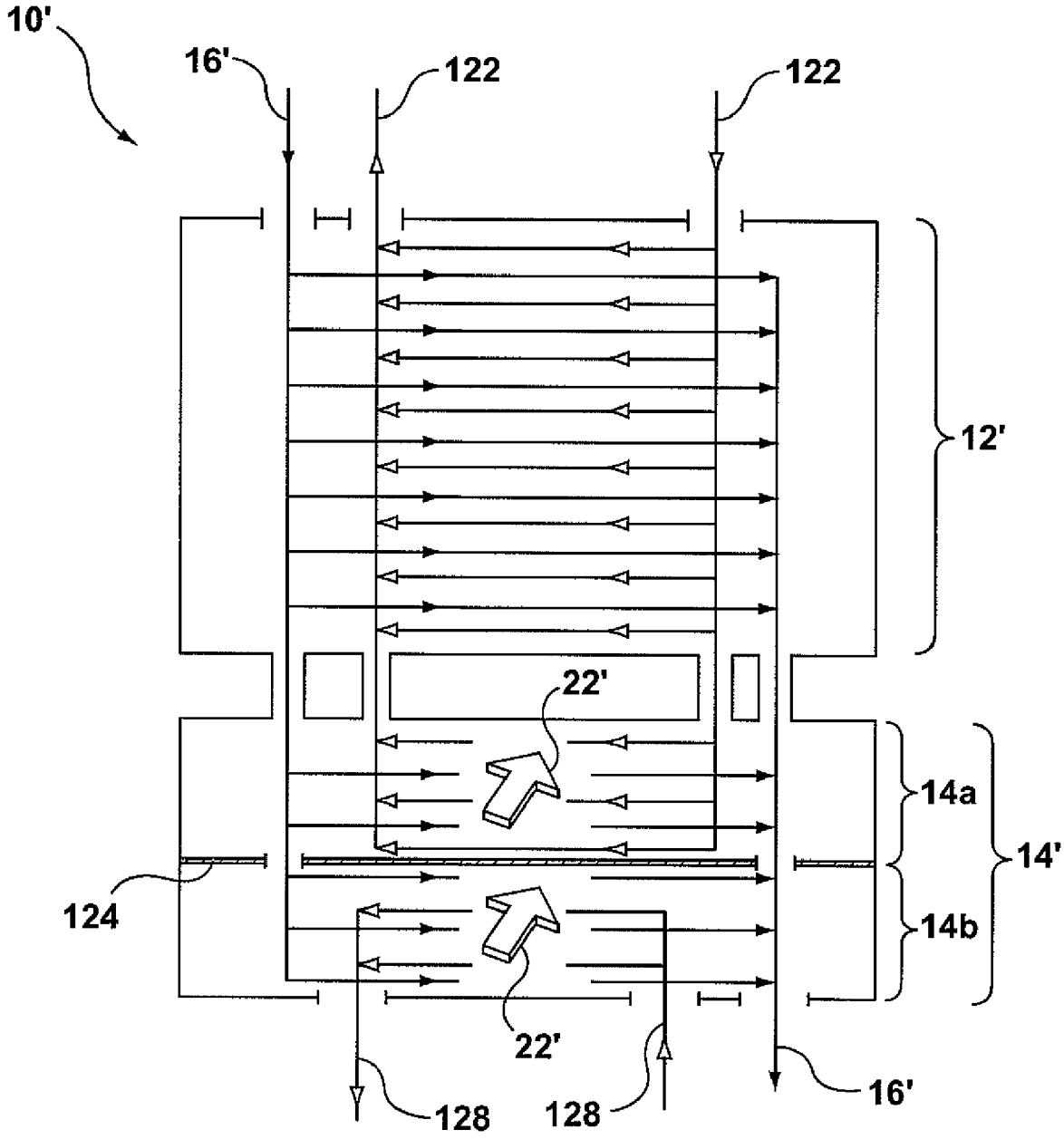
FIG. 15 is a schematic flow diagram of a heat exchanger apparatus according to yet another embodiment of the invention.

While the present invention has been described with reference to a preferred embodiment wherein the heat exchanger apparatus 10 is comprised of an oil-to-air transmission oil cooler and a multifluid heat exchanger which are coupled externally to an automobile radiator, it will be understood by persons skilled in the art that the invention is not limited to the precise embodiment described, and that variations or modifications can be made without departing from the scope of the invention as disclosed herein. For example, the multifluid heat exchangers 14, 70 discussed above may be coupled to two fluid heat exchangers other than an oil-to-air heat exchanger to form a heat exchanger apparatus according to the present invention. For instance, as shown in FIG. 15, the heat exchanger apparatus 10' may be formed of a first heat exchanger 12' in the form of an alternating plate oil-to-water heat exchanger and a second multifluid heat exchanger 14'. In this embodiment, first heat exchanger 12' in heat exchanger apparatus 10' is fed with engine coolant or water from the radiator as the first fluid 16' and with engine oil as a second fluid 122. The multifluid heat exchanger 14' is coupled to the first heat exchanger 12' and shares the engine coolant or water from the radiator as the first fluid 16'. The second multifluid heat exchanger 14', however, is separated into two sub-sections 14*a* and 14*b* by means of a divider or plate member 124; therefore the engine oil from the first heat exchanger 12' is also shared with the multifluid heat exchanger 14', however, only through the upper section 14*a* of the heat exchanger 14'. The divider plate 124 prevents the engine oil 122 from entering the bottom section 14*b* of the second multifluid heat exchanger 14'. The third fluid 22' flowing through both sections 14*a*, 14*b* of the second multifluid heat exchanger 14' is air. The bottom section 14*b* of the second multifluid heat exchanger 14' is coupled to the transmission of the automobile; therefore transmission fluid or oil is the second fluid 126 running through the bottom section 14*b*. The third fluid 22' flowing through both the upper and bottom sections 14*a*, 14*b* of the multifluid heat exchanger 14' is air. Therefore, in this embodiment, both the engine oil and the transmission fluid or oil are subject to two fluid heat exchange in an overall compact heat exchanger apparatus 10'. Accordingly, both the engine oil and transmission oil have the advantage of being heated by the water component during cold start-up conditions and benefit from the additional air cooling provided by the multifluid heat exchanger 14'.

Figure 16:
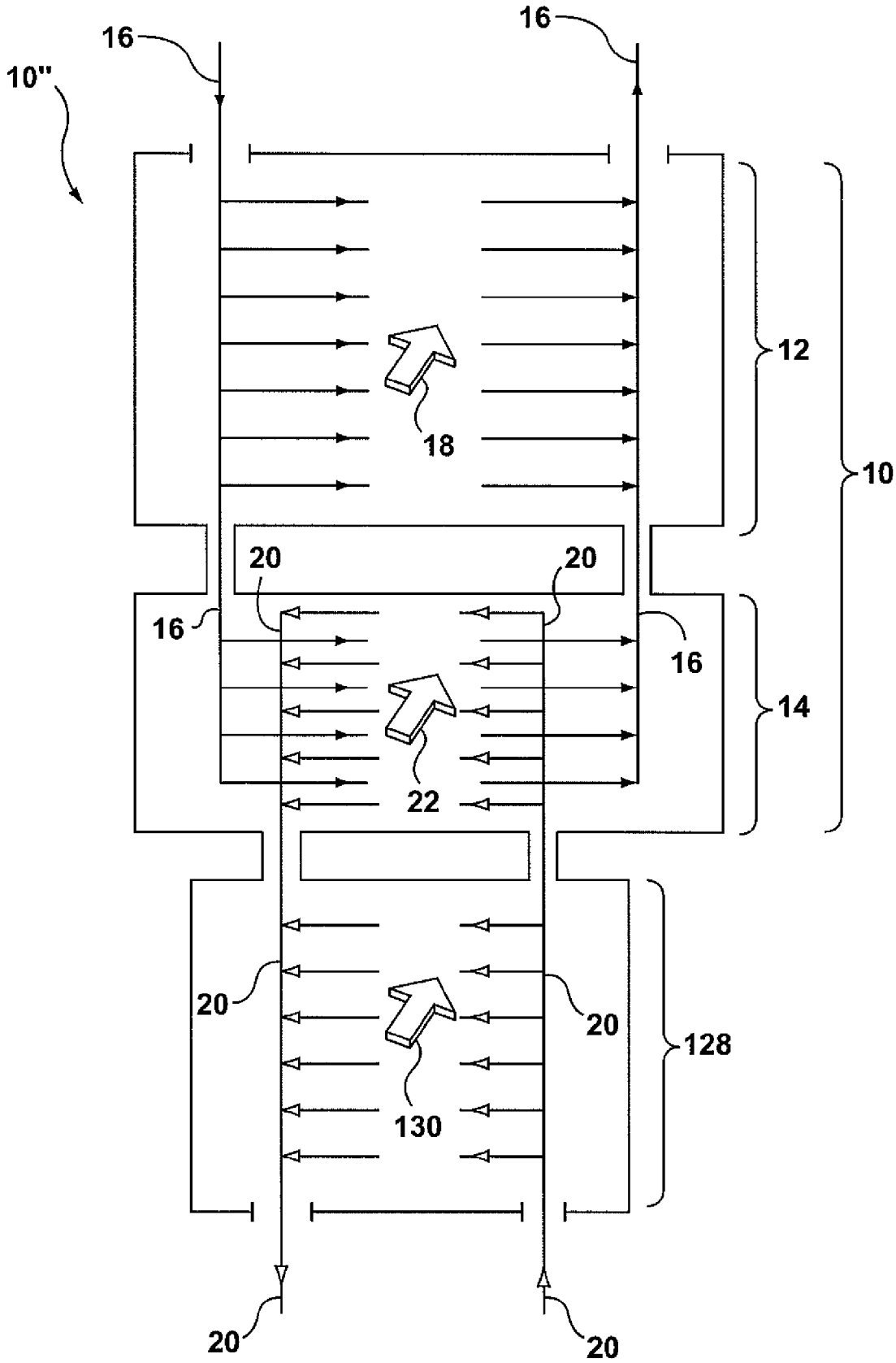
FIG. 16 is a schematic flow diagram of a heat exchanger apparatus according to a further embodiment of the invention.

In a further embodiment of the invention (See FIG. 16), the heat exchanger apparatus 10" is comprised of the heat exchanger apparatus 10 shown in FIG. 1 with another two fluid heat exchanger 128 coupled to the second multifluid heat exchanger 14. The two fluid heat exchanger 128 is in the form of an water-to-air cooler; therefore heat exchanger 128 shares the water or engine coolant 20 with the multifluid heat exchanger as its first fluid, and the second fluid 130 flowing through heat exchanger 128 is air. Heat exchanger 128 provides additional cooling (and/or heating) to the water or engine coolant before entering the heat exchanger apparatus 10 and could, therefore, be part of a sub-cooled loop in addition to the primary automobile radiator.

Figure 18:
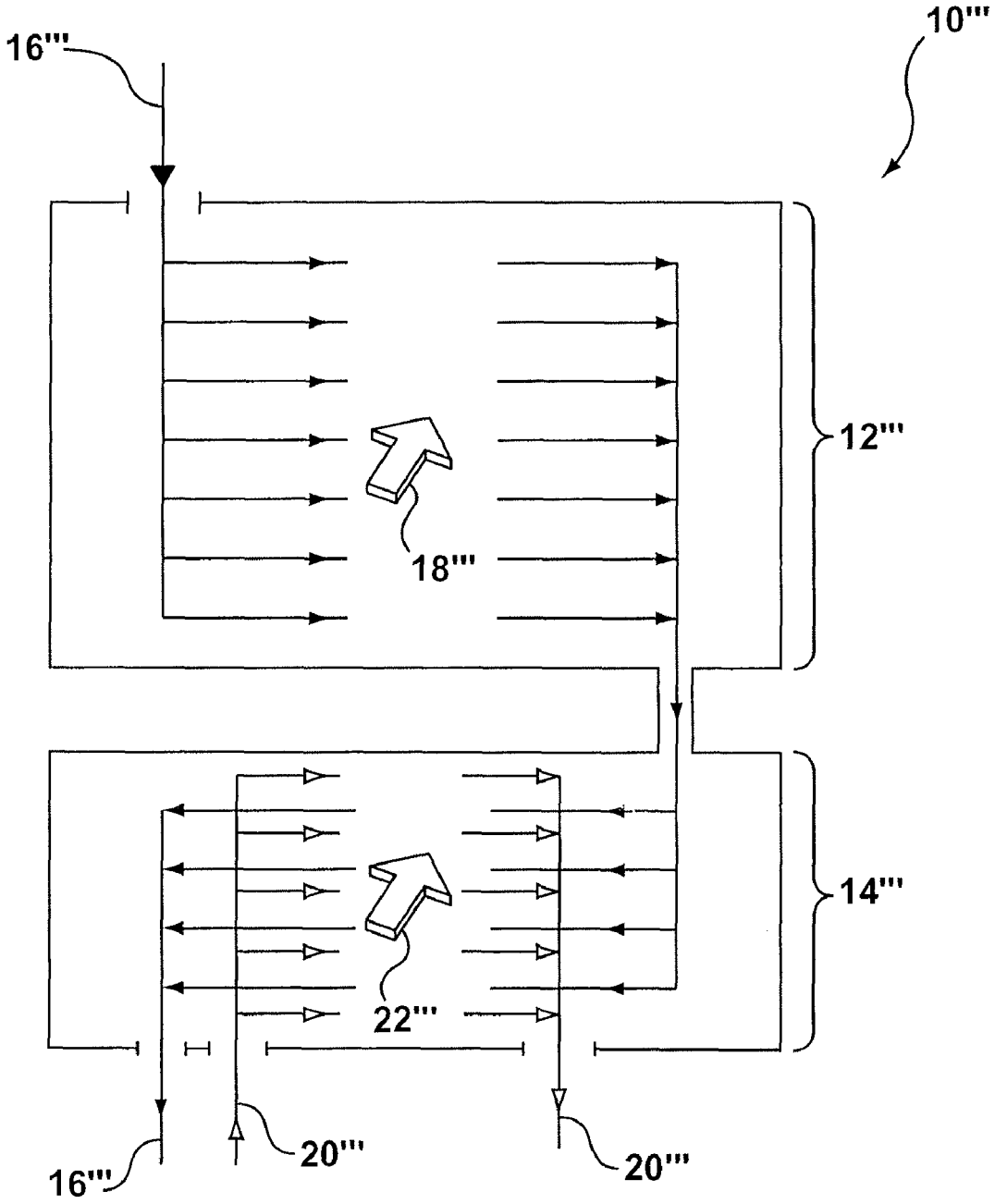
FIG. 18 is a schematic flow diagram of a heat exchanger apparatus according to a further embodiment of the invention.

Referring now to FIG. 18 there is shown yet another embodiment of the invention wherein the heat exchanger apparatus 10'" is comprised of a two fluid heat exchanger 12'" in the form of a water-to-air heat exchanger which is coupled to a second multifluid heat exchanger 14'"/70'". The first heat exchanger 12'" is fed with water or coolant as the first fluid 16'" and air acts as the second fluid 18'". The first fluid 16'" is shared with the second multifluid heat exchanger 14'" which is also fed with an oil or other fluid requiring cooling as the second fluid 20'". The third fluid 22'" flowing through the second multifluid heat exchanger 14'" would be air. This embodiment of the heat exchanger apparatus 10'" would most often be used in a sub-cooled loop within the automobile separate to the primary engine cooling radiator system.

In addition to the variations discussed above, it will be understood that the first and second heat exchangers in the heat exchanger apparatus are not limited to being stacked one-on-top of the other but can also be mounted in other configurations or in different aspects to each other. For instances, rather than being mounted one-on-top of the other, the first and second heat exchangers could be mounted with one in front of the other.

From the foregoing, it will be evident to persons skilled in the art that the heat exchanger apparatus of the present invention may be used in various applications and that the scope of the present invention is, therefore, limited only by the accompanying claims.

We claim:

1. A heat exchanger system, comprising:

a first heat exchanger, comprising:

a first module comprised of a first spaced apart plate, a second spaced apart plate, a first intermediate plate, a second intermediate plate and a first module fin, wherein said first and second intermediate plates are back-to-back, identical to one another and different from said spaced apart plates, which themselves are identical, each of said intermediate plates having a plurality of alternating ribs and grooves, wherein said ribs of said back-to-back plates together form a first fluid conduit for a first fluid and said grooves of said individual intermediate plates together with said first and second intermediate plates form a second fluid conduit for a second fluid, wherein said first and second fluid conduits share a common wall, wherein said first spaced apart plate supports said fin directly thereon, said fin transverse to said first and second fluid conduits, said fin and at least said first spaced apart plate forming a third fluid conduit for a third fluid, said third fluid conduit transverse to said first fluid conduit and said second fluid conduit, wherein said first, second and third fluids are in thermal communication with one another through said plates, but not in fluid communication with one another and said fluids are different from one another;

at least a second module, said second module comprised of a second module fin, identical to said first module fin, in direct contact with said second spaced apart plate of said first module and a second module first spaced apart plate to form a second module fluid conduit for said third fluid, said second module first spaced apart plate in direct contact with a second module first intermediate plate, said second module first spaced apart plate and said second module first intermediate plate together forming a second module second fluid conduit for said second fluid, said second module first intermediate plate in direct contact with a second module second intermediate plate, said second module intermediate plates being back-to-back and identical, each of said second module intermediate plates having a plurality of alternating ribs and grooves, wherein said ribs of said back-to-back plates together form a second module first fluid conduit for said first fluid; and a second heat exchanger, comprising a plurality of stacked tubular members defining a first set of flow channels and a second set of flow channels, wherein at least one of said same fluids in said first heat exchanger flows through said second heat exchanger.

2. The heat exchanger system according to claim 1, wherein the first heat exchanger having first heat exchanger first inlet and outlet manifolds in communication with the first fluid conduit in each of the heat exchange modules for the flow of the first fluid through the first heat exchanger and a first heat exchanger second inlet and outlet manifolds in communication with the second fluid conduit in each of the heat exchange modules for the flow of the second fluid through the first heat exchanger;

the tubular members in the second heat exchanger each having respective inlet and outlet openings, the inlet and outlet openings in one tubular member being aligned with and in communication with the respective inlet and outlet openings of an adjacent tubular member to form inlet and outlet manifolds for the flow of the at least one of said fluids in said first heat exchanger through the second heat exchanger; and one of the inlet and outlet manifolds of the second heat exchanger is connected to and in fluid communication with the first heat exchanger first inlet or outlet manifold, or the first heat exchanger second inlet or outlet manifold.

3. The heat exchanger system according to claim 2, wherein the spaced-apart plates define inlet and outlet openings in communication with each of said first and second conduits.

4. The heat exchanger system according to claim 3, wherein the spaced-apart plates are formed with bosses defining the inlet and outlet openings.

5. The heat exchanger system according to claim 4, wherein the bosses extend outwardly, the bosses in adjacent heat exchange modules engaging to form flow the manifolds.

6. The heat exchanger system according to claim 2, wherein the inlet manifold of the second heat exchanger is connected to and in fluid communication with the first heat exchanger first inlet manifold.

7. The heat exchanger system according to claim 2, wherein the outlet manifold of the second heat exchanger is connected to and in fluid communication with the first heat exchanger first outlet manifold.

8. The heat exchanger system according to claim 2, wherein the inlet manifold of the second heat exchanger is connected to and in fluid communication with the first heat exchanger second inlet manifold.

9. The heat exchanger system according to claim 2, wherein the outlet manifold of the second heat exchanger is connected to and in fluid communication with the first heat exchanger second outlet manifold.

10. The heat exchanger system according to claim 2, wherein the inlet manifold of the second heat exchanger is connected to and in fluid communication with the first heat exchanger first outlet manifold.

11. The heat exchanger system according to claim 2, wherein the inlet manifold of the second heat exchanger is connected to and in fluid communication with the first heat exchanger second outlet manifold.

12. The heat exchanger system according to claim 2, wherein the outlet manifold of the second heat exchanger is connected to and in fluid communication with the first heat exchanger first inlet manifold.

13. The heat exchanger system according to claim 2, wherein the outlet manifold of the second heat exchanger is connected to and in fluid communication with the first heat exchanger second inlet manifold.

14. The heat exchanger system according to claim 1, wherein said second heat exchanger is a water-to-air plate and fin type heat exchanger.

15. The heat exchanger system according to claim 1, wherein said second heat exchanger is an oil-to-air plate and fin type heat exchanger.

16. The heat exchanger system according to claim 1, wherein said second heat exchanger is an alternating plate oil-to-water heat exchanger.

* * * * *